US010351333B2

(12) United States Patent
Li

(10) Patent No.: US 10,351,333 B2
(45) Date of Patent: Jul. 16, 2019

(54) DISPENSING CONTAINER

(75) Inventor: Yang Li, Mississagua (CA)

(73) Assignee: Gumfriend International Corp., Valley Cottage, NY (US)

( * ) Notice: Subject to any disclaimer, the term of this patent is extended or adjusted under 35 U.S.C. 154(b) by 0 days.

(21) Appl. No.: 14/424,637

(22) PCT Filed: Sep. 1, 2012

(86) PCT No.: PCT/CN2012/080892

§ 371 (c)(1),
(2), (4) Date: Dec. 18, 2015

(87) PCT Pub. No.: WO2014/032296

PCT Pub. Date: Mar. 6, 2014

(65) Prior Publication Data

US 2016/0130071 A1 May 12, 2016

(51) Int. Cl.
*B65D 83/04* (2006.01)
*B65D 85/60* (2006.01)

(52) U.S. Cl.
CPC ..... *B65D 83/0409* (2013.01); *B65D 85/60* (2013.01); *B65D 2583/0472* (2013.01)

(58) Field of Classification Search
CPC ..... A61J 1/03; B65D 83/04; B65D 83/0409; B65D 83/0427; B65D 85/60; B65D 2583/0472; B65D 2583/0481
See application file for complete search history.

(56) References Cited

U.S. PATENT DOCUMENTS 2,039,282 A * 5/1936 Burke ..... G07F 11/44 194/252
2,341,447 A * 2/1944 Klotz ..... B65D 83/0409 221/246
2,669,349 A * 2/1954 Silver ..... B65D 83/0409 221/202
3,301,437 A * 1/1967 Faber ..... B65D 83/0409 221/202
3,310,201 A * 3/1967 Guarr ..... B65D 83/0409 221/197
3,319,827 A * 5/1967 Englesson ..... B65D 83/04 221/155
3,362,583 A * 1/1968 Showalter ..... B65D 83/0409 221/281
3,610,466 A * 10/1971 Raybois ..... B65D 83/0409 221/135

(Continued)

*Primary Examiner* — Gene O Crawford
*Assistant Examiner* — Kelvin L Randall, Jr.
(74) *Attorney, Agent, or Firm* — Banner & Witcoff, Ltd.

(57) ABSTRACT

A novel chewing gum box includes a gum storage chamber, a storage chamber cover, a funnel apparatus, a gum introducing plate, a gum carrying groove, a carrying groove baffle, a push handle, a spring baffle, guide rails, guide rail grooves, a spring groove, and a spring. The gum storage chamber is communicated with the gum carrying groove through the funnel apparatus. The gum carrying groove is connected to the push handle and is capable of reciprocating along the guide rails and the guide rail groove. When retrieving gum, the box body is tilted and shaken first to allow gum in the storage chamber to slide along the gum introducing plate into the gum carrying groove via the funnel apparatus. The push handle then is actuated to have the gum pushed out along the guide rail and the guide rail groove, so that the gum is available for retrieval.

7 Claims, 5 Drawing Sheets

(56) References Cited

U.S. PATENT DOCUMENTS 3,788,517 A * 1/1974 Eannarino ..... B65D 83/0409 206/528
3,828,972 A * 8/1974 Bender ..... A61J 7/04 221/197
4,557,690 A * 12/1985 Randin ..... A61C 19/00 221/288
5,174,471 A * 12/1992 Kozlowski ..... B65D 83/0409 206/536
5,205,424 A * 4/1993 Gaspar ..... B65D 50/067 215/210
5,482,183 A * 1/1996 Beal ..... A61J 7/0076 221/150 A
5,553,739 A * 9/1996 Plum ..... B65D 83/0409 221/196
6,763,971 B1 * 7/2004 Tong ..... G07F 11/44 221/151
6,976,576 B2 * 12/2005 Intini ..... A45D 33/20 206/1.5
7,360,669 B2 * 4/2008 Drajan ..... B65D 83/0409 221/208
2003/0159965 A1 * 8/2003 Baker ..... B65D 83/04 206/540
2004/0124204 A1 * 7/2004 Giraud ..... B65D 83/0409 221/263
2005/0205598 A1 * 9/2005 Gelardi ..... B65D 83/0409 221/263
2007/0000938 A1 * 1/2007 Renaud ..... B65D 83/04 221/263
2007/0114239 A1 * 5/2007 Smith ..... B65D 83/0409 221/263
2008/0011773 A1 * 1/2008 Tobias ..... B65D 83/0409 221/264
2013/0008918 A1 * 1/2013 Cronin ..... B65D 83/0409 221/174

* cited by examiner

[Fig. 1]
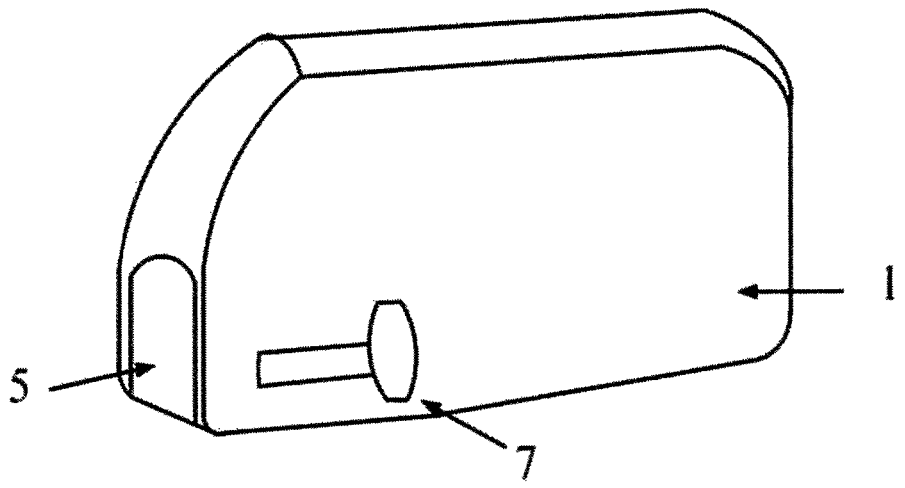
[Fig. 2]
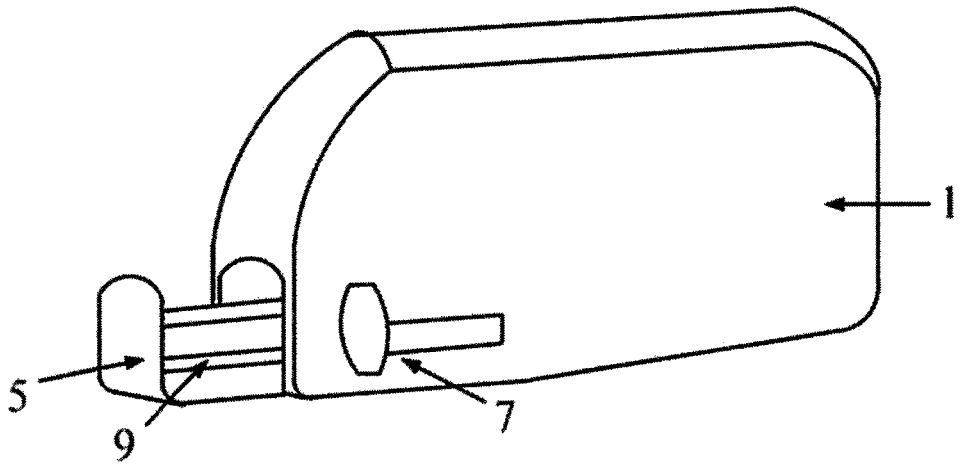

[Fig. 3]
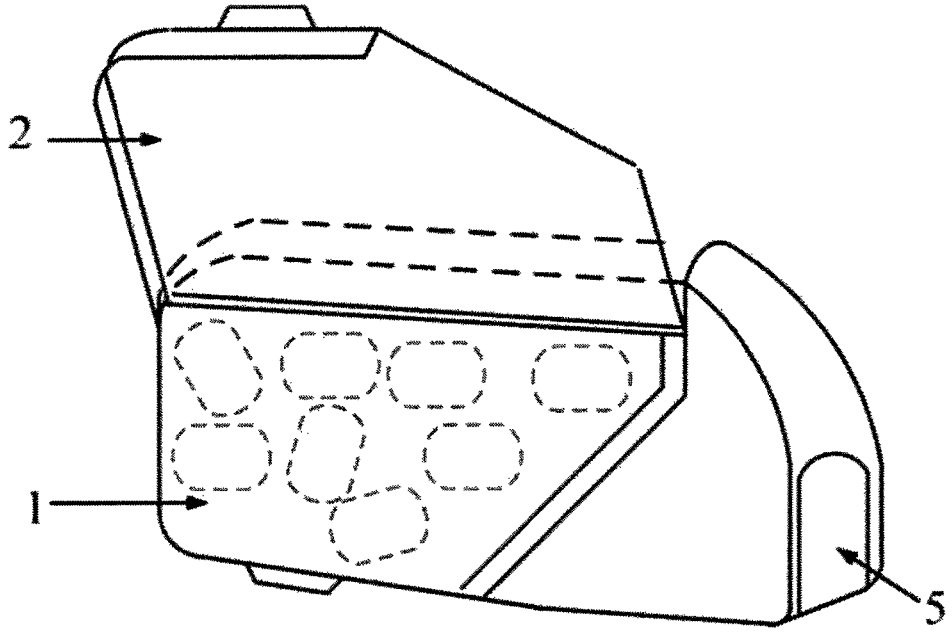
[Fig. 4]
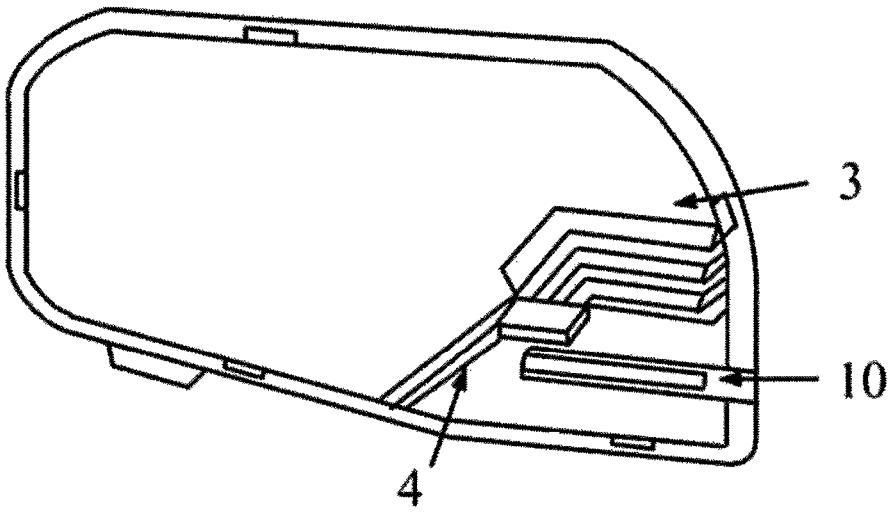

[Fig. 5]
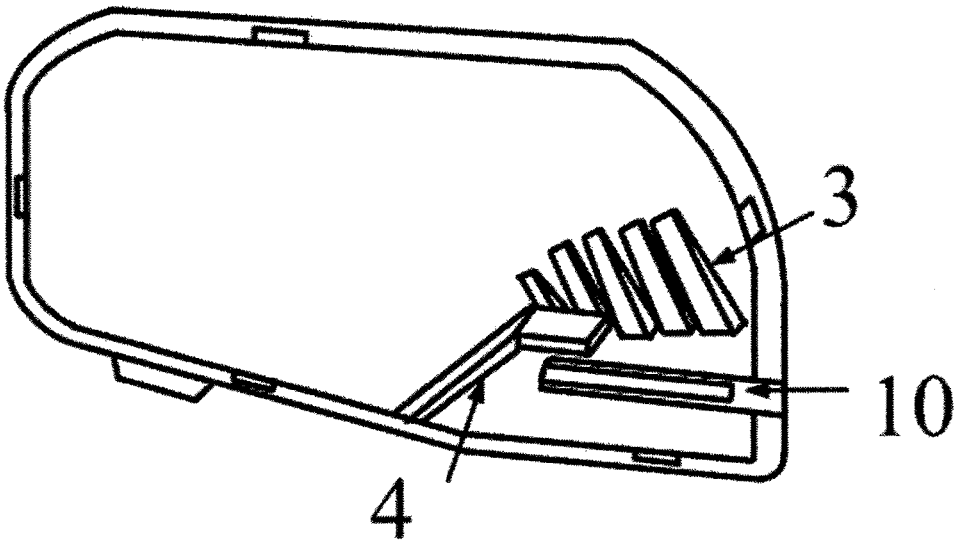
[Fig. 6]
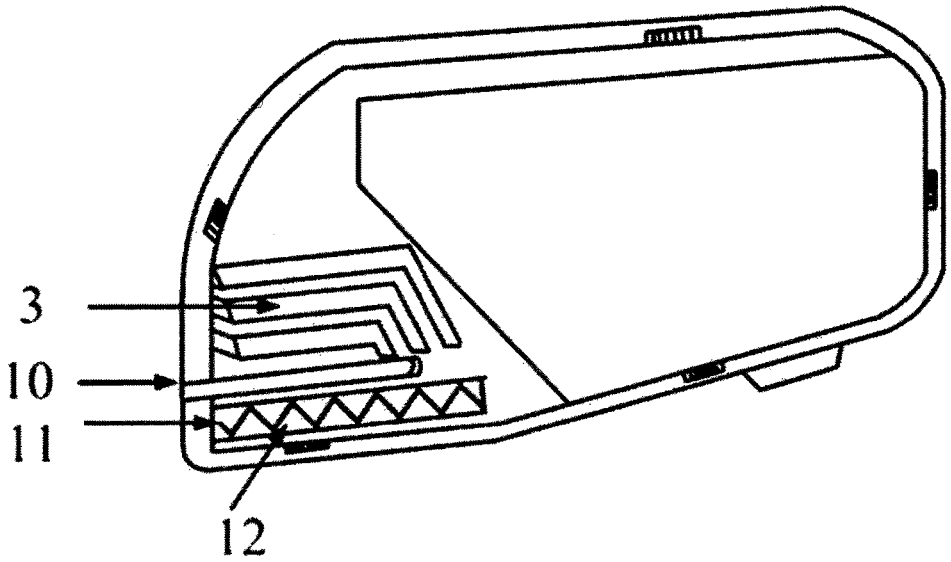

[Fig. 7]
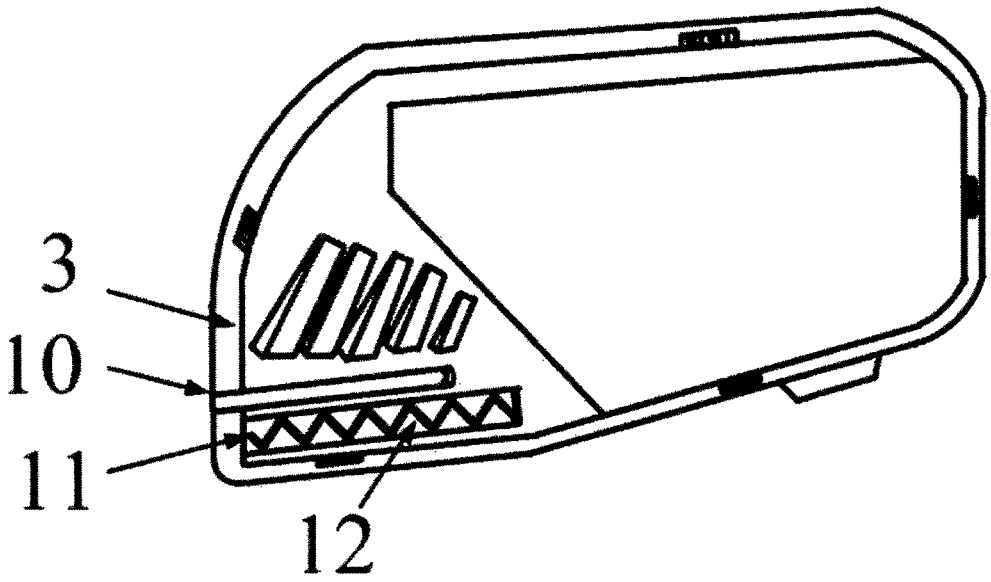
[Fig. 8]
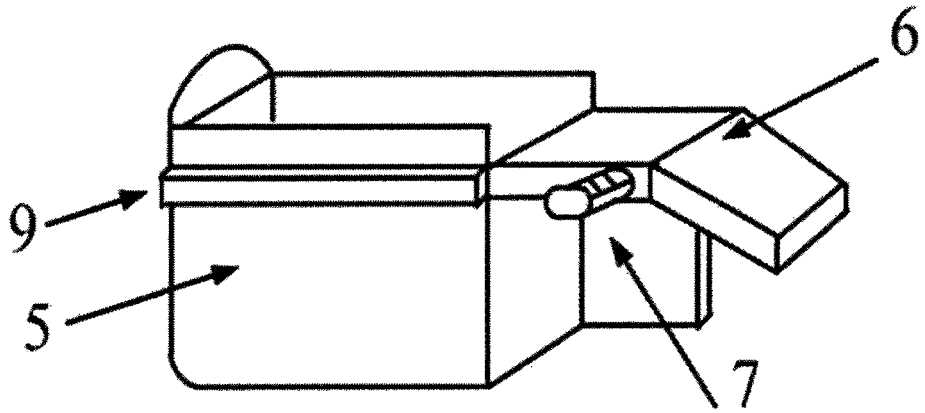

[Fig. 9]
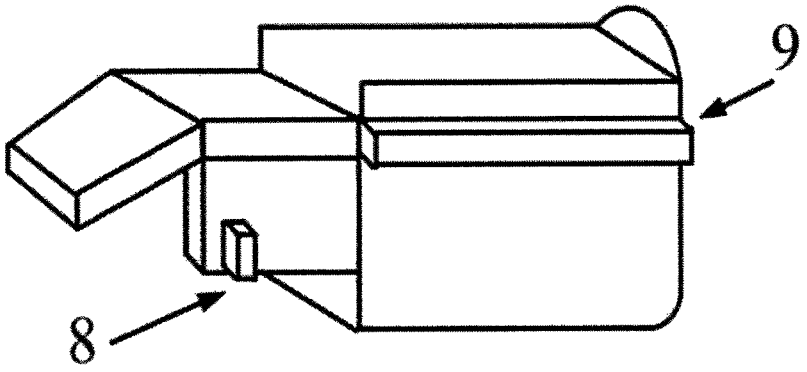

DISPENSING CONTAINER

This application is a U.S. national stage application of International Application PCT/CN2012/080892, filed Sep. 1, 2012.

TECHNICAL FIELD

The invention relates to the field of daily use manufacturing technology, particularly to a novel dispensing container such as a chewing gum box.

BACKGROUND

Chewing gum is a common consumer product, used for cleaning teeth to prevent oral cavities, protecting teeth, lowering stress and facilitating facial beauty. Most chewing gum packaging, while designed simply yet, produces several undesirable disadvantages. For example, in many cases, it is difficult to control the dispensing of the packaging contents. Thus, when trying to take a piece of chewing gum, multiple pieces may be poured out into the user's hands. In addition to being inconvenient, such practice also may by unhygienic, as the user may have to handle the unwanted pieces to put them back in the packaging. Additionally, much packaging of this type is not designed to be reusable, resulting in resource waste.

BRIEF SUMMARY

The invention aims to provide a novel chewing gum box for solving the abovementioned deficiencies.

In one aspect, a novel chewing gum box may include the following components: a chewing gum storage chamber, a storage chamber cover, a funnel apparatus, a chewing gum introducing plate, a chewing gum carrying groove or holder, a carrying groove baffle, a push handle, a spring baffle, guide rails, guide rail grooves, a spring groove and a spring. The chewing gum storage chamber is communicated with the chewing gum carrying groove through the funnel apparatus. The chewing gum carrying groove is connected with the push handle and is capable of performing reciprocating motion along the guide rails and the guide rail grooves between a stored position located within the housing and a dispensing position located external to the housing. The funnel apparatus is composed of a plurality of transverse or obliquely vertical or sloped bodies of increasing thickness that are arranged on the two sides of the inside of the box. The funnel apparatus also is disposed above and transversely in-line with the groove. The chewing gum introducing plate is connected with the funnel apparatus. Additionally or alternatively, the chewing gum introducing plate extends between and perpendicular to the storage chamber sides and is further configured to separate the chewing gum storage chamber and the chewing gum carrying groove. The size and shape of the chewing gum carrying groove is suitable for accommodating one or several pieces of chewing gum. Guide rails are arranged on the two sides of the chewing gum carrying groove, and the inner side of the box is provided with the guide rail groove. The rear part of the chewing gum carrying groove is connected with the carrying groove baffle. The spring baffle is arranged on one side of the chewing gum carrying groove. One side of the box is internally provided with the spring groove, and the spring is installed therein, such that one end of the spring is coupled to the chewing gum carrying groove and the opposite end of the spring is coupled to the box. Interactions are performed between the spring and the spring baffle on the side of the spring groove, such that the spring is configured to return the chewing gum carrying groove from a dispensing position to a stored position.

Compared with existing technologies, the invention has the beneficial effects of simple structure, convenient use, environmental friendliness and health.

BRIEF DESCRIPTION OF THE FIGURES

The following contents will further illustrate the invention by integrating figures and embodiments:

FIG. 1 is an isometric view of the solid diagram of the chewing gum box with a gum carrying groove in a retracted position.

FIG. 2 is an isometric view of the chewing gum box of FIG. 1 when the chewing gum carrying groove is pushed out.

FIG. 3 is an isometric view of the reverse side of the chewing gum box of FIG. 1 with the storage chamber cover in an open position.

FIG. 4 is an isometric isolated view of a chewing gum box showing the inner side of a left-half part of the chewing gum box and showing a hopper.

FIG. 5 is an isometric isolated view of another embodiment of a chewing gum box showing the inner side of the left-half part of the chewing gum box and showing another hopper.

FIG. 6 is an isometric isolated view of the chewing gum box of FIG. 4 showing the inner side of the right-half part of the chewing gum box and showing a hopper.

FIG. 7 is an isometric isolated view of the chewing gum box of FIG. 5 showing the inner side of the right-half part of the chewing gum box and showing another hopper.

FIG. 8 is an isometric isolated view showing the left side of the chewing gum carrying groove.

FIG. 9 is an isometric isolated view showing the right side of the chewing gum carrying groove.

The definitions of numbers in the figures: 1. chewing gum storage chamber, 2. storage chamber cover, 3. funnel apparatus, 4. chewing gum introducing plate, 5. chewing gum carrying groove or holder, 6. carrying groove baffle, 7. push handle, 8. spring baffle, 9. guide rail, 10. guide rail groove, 11. spring groove, 12. spring.

DETAILED DESCRIPTION

The chewing gum box is mainly composed of a chewing gum storage chamber 1, a storage chamber cover 2, a funnel apparatus 3, a chewing gum introducing plate 4 adjacent the funnel apparatus 3, the introducing plate 4 dividing the box into an upper chamber and a lower chamber, the upper chamber defining the storage chamber 1, a chewing gum carrying groove or holder 5, a carrying groove baffle 6, a push handle 7, a spring baffle 8, guide rails 9, guide rail grooves 10, a spring groove 11 and a spring 12.

In order to dispense chewing gum, a user may obliquely shake the box body to transfer chewing gum in the chewing gum storage chamber 1 into the chewing gum carrying groove or holder 5, e.g., by causing the gum to slide along the chewing gum introducing plate 4 via the funnel apparatus 3. The chewing gum carrying groove 5 may include a plurality of parallel sidewalls and a base extending between and joining those sidewalls, where both the sidewalls and the base extend parallel to a direction of motion of the gum carrying groove 5. As such, the sidewalls and base may form a cavity or bucket for receiving and confining the gum to be dispensed as and after the carrying groove 5 is moved into a pushed out or dispensing position. The user then may push the push handle 7 to have the chewing gum in the chewing gum carrying groove 5 be pushed out along the guide rail 9 and the guide rail groove 10. The push handle 7 translates along a groove that extends completely through one of the sides of the box. Once the gum carrying groove 5 is in the pushed out or dispensing position, the user then may take out the chewing gum from the groove 5.

The carrying groove baffle 6 is movable with the chewing gum carrying groove 5 and is configured to prevent chewing gum from falling into the gap that is formed during the course of pushing out the chewing gum carrying groove 5. The carrying groove baffle 6 also is configured to nest with the chewing gum introducing plate 4 when the groove is not pushed out. Additionally, once the chewing gum carrying groove is pushed out, the user can loosen the push handle 7 so that the chewing gum carrying groove 5 can return to the inside of the box body under the effect of the spring 12. Moreover, the dispenser is configured such that the storage chamber cover 2 may be hingedly opened to add new chewing gum, e.g., when the chewing gum in the storage chamber 1 has been taken out completely. Thus, the apparatus is rationally designed, structurally simple, and convenient to use.

The invention claimed is:

1. A dispensing container, comprising:

a first side, a second side, a third narrow side, a fourth narrow side, a top, a bottom, a storage chamber (1), a storage chamber cover (2), a funnel apparatus (3), an introducing plate (4), a carrying holder (5), a carrying groove baffle (6), a carrying holder exit disposed on the third narrow side of the container and near the bottom of the container, wherein the carrying holder (5) is configured to take reciprocating motion through the carrying holder exit between a stored position and a dispensing position, a push handle (7), a spring baffle (8), a guide rail (9), a guide rail groove (10), a spring groove (11), and a spring (12), wherein a first region of the container and a second region of the container are adjacent and defined by and span an area between the first side and the second side, the first region comprising the storage chamber (1) and the second region comprising the carrying holder (5), the carrying groove baffle (6), the spring (12), and the push handle (7) when the carrying holder (5) is in the stored position;

wherein the introducing plate (4) extends between the first side and the second side of the container, wherein the introducing plate (4) follows the funnel apparatus (3) and both span the area between the first side and the second side of the container, wherein in the stored position, the funnel apparatus and the introducing plate extend from the carrying holder exit on the third narrow side to the bottom of the container over the carrying holder (5), the carrying groove baffle (6), the push handle (7), and the spring (12) to define a common boundary between the first region and the second region, such that the whole first side of the introducing plate (4) contacts the second region and a wide entrance of the funnel apparatus (3) contacts the first region and a narrow exit of the funnel apparatus (3) contacts the second region, wherein the funnel apparatus (3) is adjacent the carrying holder (5), the funnel apparatus configured to direct contents of the storage chamber (1) into the carrying holder (5), and wherein the carrying holder (5) is connected with the push handle (7) to effectuate the reciprocating motion.

2. The dispensing container as claimed in claim 1, wherein the funnel apparatus (3) is composed of a plurality of transverse or obliquely vertical or slope bodies that are arranged on each of the first and second sides.

3. The dispensing container as claimed in claim 1, wherein the introducing plate (4) is connected with the funnel apparatus (3), and the introducing plate (4) is further configured to separate the storage chamber (1) and the carrying holder (5).

4. The dispensing container as claimed in claim 1, wherein a size and shape of the carrying holder (5) are suitable for accommodating one or several pieces of contents of the storage chamber (1).

5. The dispensing container as claimed in claim 1, wherein the guide rail and a second guide rail (9) are arranged on opposite sides of the carrying holder (5), and opposing inner sides of the container are provided with the guide rail groove and a second guide rail groove (10).

6. The dispensing container as claimed in claim 1, wherein a rear part of the carrying holder (5) is connected with the carrying groove baffle (6), and the spring baffle (8) is arranged on one side of the carrying holder (5).

7. The dispensing container as claimed in claim 1, wherein the container is internally provided with the spring groove (11), wherein the spring (12) is installed within the spring groove (11), and wherein the spring (12) is operably coupled to the spring baffle (8).

* * * * *